US005083435A

United States Patent [19]

Lin

[11] Patent Number: 5,083,435

[45] Date of Patent: Jan. 28, 1992

[54] EXHAUST PIPE WITH TURBINE VANE

[76] Inventor: Ching-Chih Lin, No. 20, Lane 161, Chilin Rd., Taipei, Taiwan

[21] Appl. No.: 555,840

[22] Filed: Jul. 23, 1990

[51] Int. Cl.[5] ..... F01N 3/02

[52] U.S. Cl. ..... 60/280; 60/311; 60/902

[58] Field of Search ..... 60/280, 311, 902, 309

[56] References Cited

U.S. PATENT DOCUMENTS 1,637,516 8/1927 Brilliant ..... 60/902

3,050,375 8/1962 Block ..... 60/902

3,350,877 11/1967 Bowman ..... 60/902

*Primary Examiner*—Douglas Hart

*Attorney, Agent, or Firm*—Asian Pacific International Patent & Trademark Office

[57] ABSTRACT

An exhaust pipe for connection to an exhaust pipe of an engine to filtrate dirt from exhaust gas comprises therein a center shaft having connected thereto a turbine vane and a filter device in series. Exhaust gas from engine turns the turbine vane to cause the filter device to rotate so as to efficiently filtrate impurities from exhaust gas.

4 Claims, 3 Drawing Sheets

EXHAUST PIPE WITH TURBINE VANE

BACKGROUND OF THE INVENTION

The present invention is related to an exhaust pipe, and more particularly, to an exhaust pipe for connection to an exhaust pipe of an engine to filtrate impurities from exhaust gas so as to eliminate possible air pollution.

In recent years, because of economic and industrial prosperities automobiles have become popular. Following the increasing amount of automobiles on the roads, air pollution problem has become more serious each day. Incomplete combustion of fuel generally cause an engine to exhaust black smoke to pollute the air. Driving a car of poor quality or suddenly stepping on the accelerator of a car while driving on a road of poor quality will generally cause incomplete combustion problem and exhaust black smoke.

The present invention is designed to provide an exhaust pipe with turbine vane to efficiently filtrate exhaust gas from an engine so as to eliminate possible air pollution. An exhaust pipe of the present invention generally comprises a turbine vane and a filter device respectively connected to a center shaft in series. Exhaust gas from an engine turns the turbine vane to rotate so as to drive the filter device to filtrate exhaust gas before exhaust gas is discharged.

SUMMARY OF THE INVENTION

According to a first aspect of the present invention, an exhaust pipe is provided to allow the exhaust gas from an engine passing through a turbine vane and a filter device to filtrate engine exhaust gas.

According to a second aspect of the present invention, an exhaust pipe comprises a filter device formed of a plurality of aluminum round rods closely connected together around a circle and supported by two circular frame members at two opposite ends to stop impurities from entering and spin impurities toward a wire gauze filter covered therearound by means of centrifugal force; and a screen member at the front and formed of stainless steel wire gauze in 300 meshes per inch for filtrating exhaust gas.

According to a third aspect of the present invention, an exhaust rear pipe comprises a turbine vane and a filter device made of acid-proof, alkali-resisting, light weight material and connected to a center shaft in series. Its center shaft has two opposite ends fastened in two bearings at the two opposite ends of the housing thereof and is permitted to smoothly rotate inside the housing.

According to a fourth aspect of the present invention, an exhaust rear pipe comprises a housing having two drains at the bottom for discharge of dirt out of the housing by blocking up the exhaust gas outlet hole thereof so as to extend the duration of the device and improve its performance.

BRIEF DESCRIPTION OF THE DRAWINGS

The present invention will now be described by way of example with reference to the accompanying drawings, in which.

DETAILED DESCRIPTION OF THE PREFERRED EMBODIMENT

Figure 1:
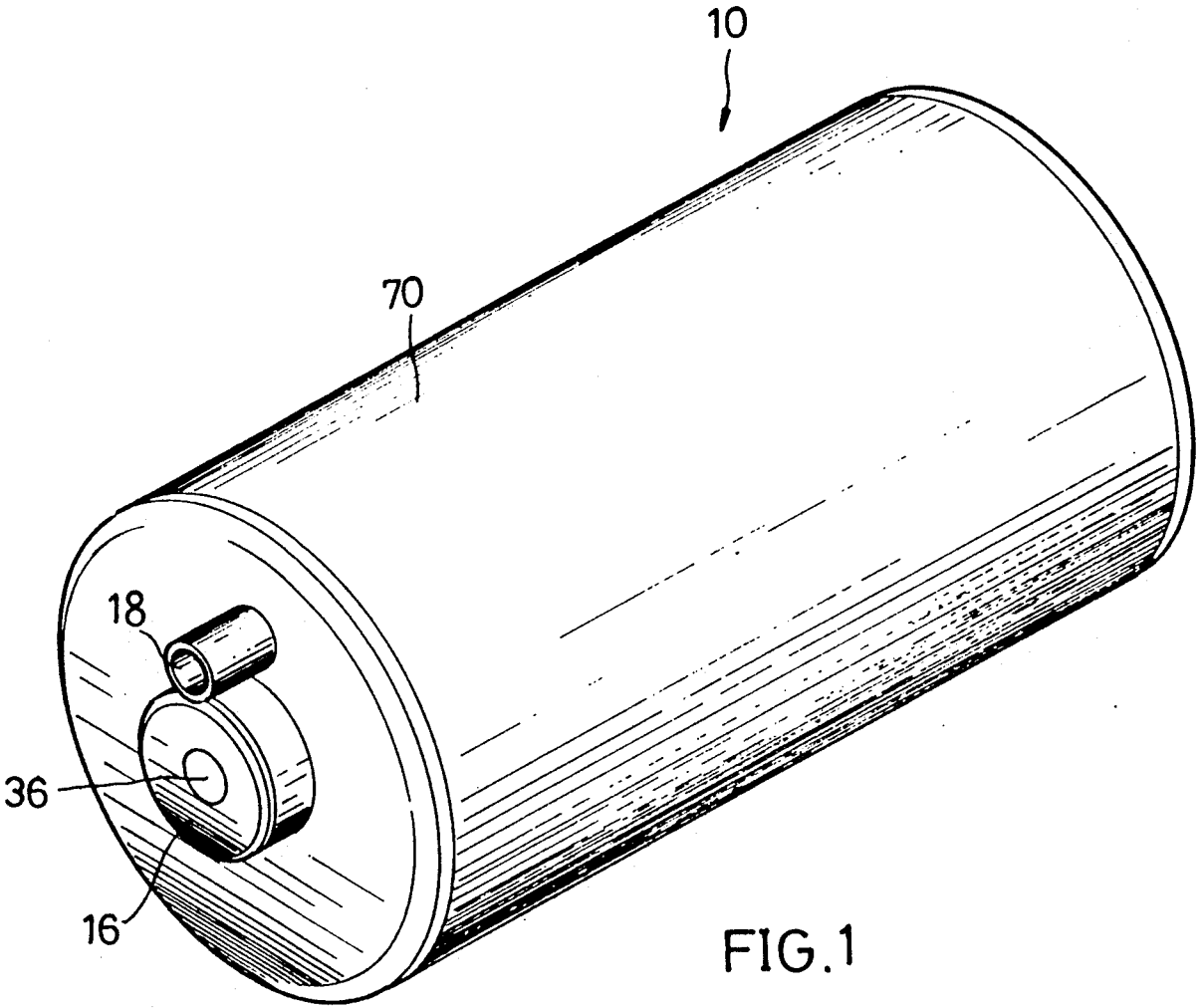
FIG. 1 is a perspective view of an exhaust pipe embodying the present invention.
Figure 2:
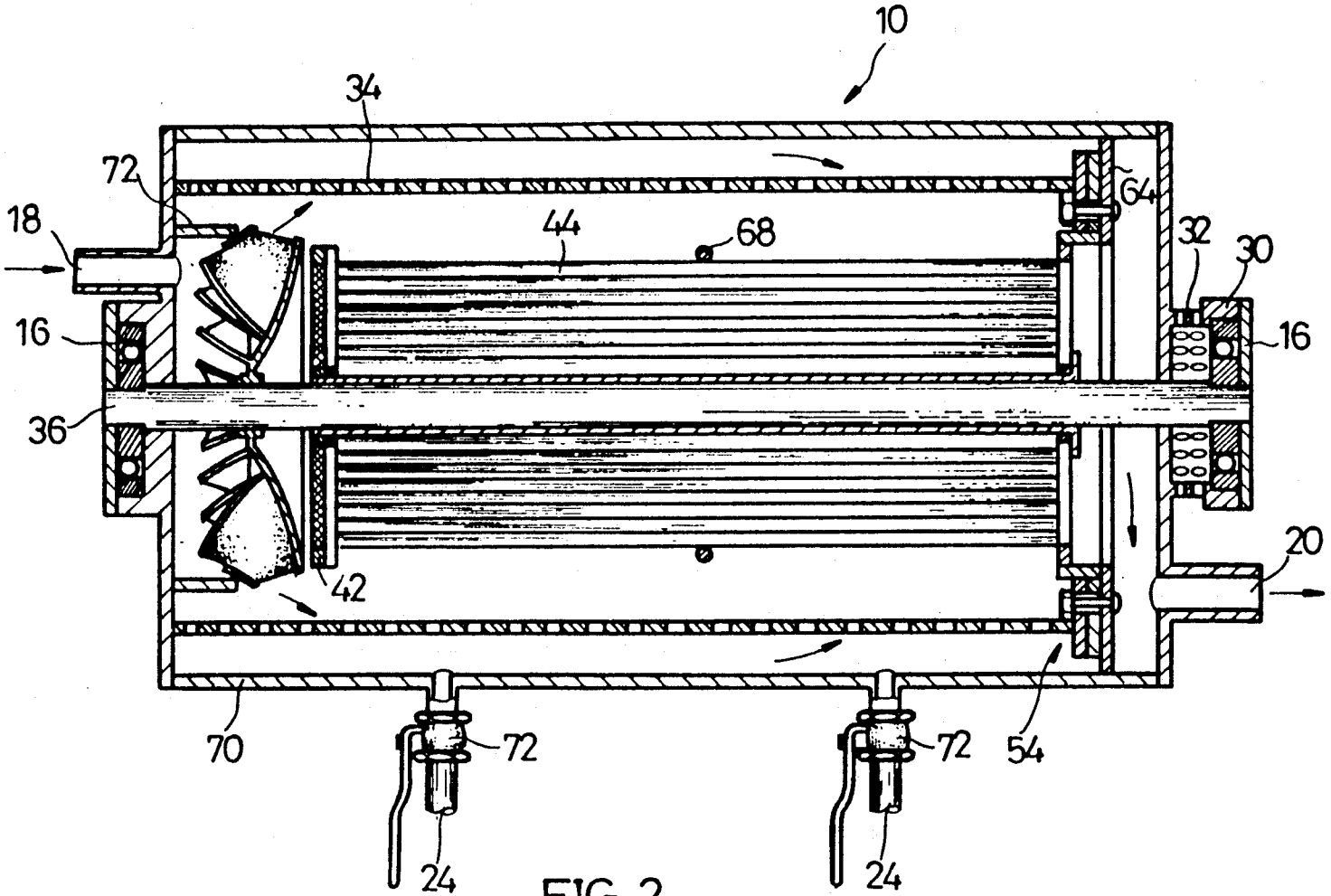
FIG. 2 is a sectional view taken on line 2—2 of FIG. 1.
Figure 3:
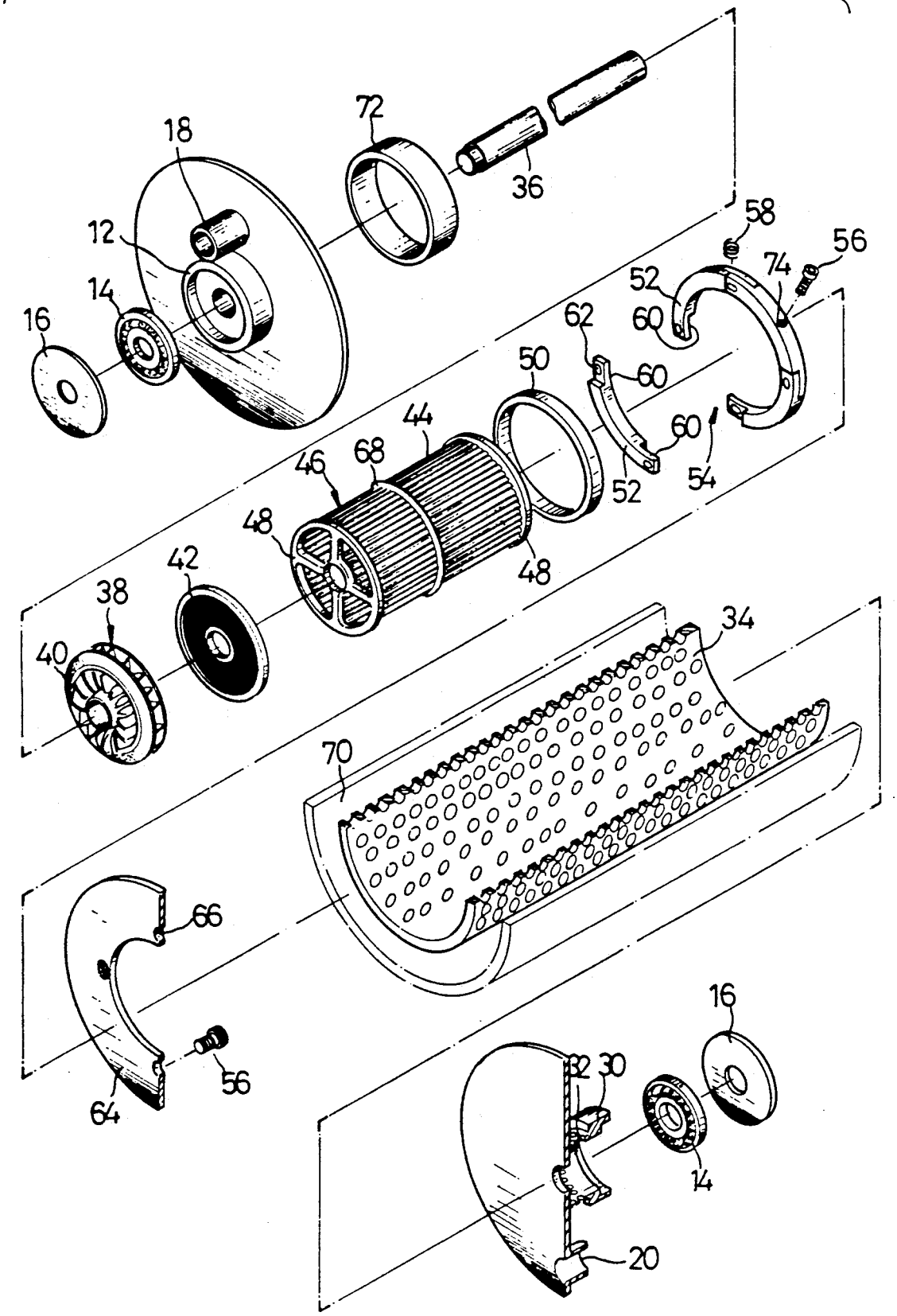
FIG. 3 is a perspective fragmentary view thereof.

Turning now to the accompanying drawings in more detail, therein illustrated is an exhaust rear pipe 10 embodying the present invention and for connection to a muffler at the rear end, which comprises an enclosed, cylindrical housing 70 made of aluminum alloy. The housing 70 comprises at one end a flange 12 which has a bearing 14 fastened therein and is covered with a bearing cover 16, and an exhaust gas inlet 18, connected to the exhaust pipe of an engine, and at an opposite end disposed another flange 30, which has a plurality of vents 32 on its periphery at an inner side for discharge of heat and is fastened with a bearing 16 and covered with a bearing cover 16, and an exhaust gas outlet 20 for discharge of exhaust gas into the air; and at the bottom two drains 24 respectively controlled by a control valve 72 for discharge of residue of exhaust gas. Under normal condition, the control valves 72 in the two drains 24 are closed. When clearing residue of exhaust gas inside the housing 70, the exhaust gas outlet 20 is closed so that residue of the exhaust gas inside the housing 70 can be discharged through the two drains 24.

There is a tubular wire gauze filter 34 fastened in the housing 70. A center shaft 36 is fastened between the two opposite bearings 14 inside the housing 70. A substantially circular division board 72 and a turbine vane 38 are mounted on the center shaft 36 at a suitable position. The turbine vane 38 is designed in a disk-like structure and formed of light-weight alloy or other suitable light-weight material. A wing-like portion 40 is made on the turbine vane 38 at the front for guiding exhaust gas to turn the turbine vane 38 to rotate. A screen member 42 is mounted on the center shaft 36 at the back of the turbine vane 38, which is designed in 300 meshes per inch. A filter device 46 is mounted on the center shaft 36 at the back of the screen member 42, which comprises a cylindrical body formed of a plurality of round rods 44 made of aluminum alloy and retained by a hoop 68 at the middle and supported by two circular frame members 48 at two opposite ends. A ring-shaped member 50 is fastened on the rear end of the filter device 46. A ring-shaped retainer device 54 is fastened on the ring-shaped member 50, which is formed of four pieces of elements 52 made of teflon. Each elements 52 has two connecting portions 60 at two opposite ends with a hole 62 made thereon. A plurality of compression springs 58 are equidistantly fastened in the periphery of the ring-shaped retainer device 54 and respectively stopped against the inner wall surface of the housing 70. A plurality of bolt holes 74 are equidistantly made on the periphery of the ring-shaped retainer device 54 for the insertion therein of a screw means 56 each to firmly secure the ring-shaped retainer device 54 to the ring-shaped member 50, permitting the inner diameter of the ring-shaped retainer device 54 to tightly attach to the outer diameter of the ring-shaped member 50. There is provided with a circular fastening plate 64 having a plurality of bolt holes 66 corresponding to the holes 62 on the ring-shaped retainer device 54 for the insertion therein of a screw means 56 each to fixedly secure the circular fastening plate 64 to the ring-shaped retainer device 54.

During operation, exhaust gas which enters the housing 70 from the exhaust gas inlet 18 through the turbine vane 40 is filtrated through the wire gauze filter 34, the screen member 42 and the round rods 44 of the filter device 46 and eventually out of the housing 70 into the air via the exhaust gas outlet 20.

After a certain period of time in performance, carbon residue may be accumulated inside the housing 70, blocking up the exhaust gas outlet hole 20. Under this condition, blocking up the exhaust gas outlet 20 and turning on the two control valves 72 permit the exhaust gas and the carton residue to discharge through the two drain 24. The exhausted carbon residue from the two drain 24 can be collected for further use, for example, for manufacturing car tires.

What is claimed is:

1. An exhaust pipe connected to an exhaust pipe of an engine, comprising:

a housing of hollow cylindrical shape made of light weight aluminum alloy comprising a front flange and an exhaust gas inlet at one end, a rear flange and an exhaust gas outlet at an opposite end, and two drains at the bottom, said front and rear flanges having each a bearing fastened therein with a bearing cover attached thereto, said rear flange having a plurality of vents on its periphery at an inner side, said drains having each a control valve fastened therein to control its passage;

a center shaft fastened between the bearings in said front and rear flanges inside said housing;

a turbine vane fastened on said center shaft near said exhaust gas inlet, being designed in a disk-like structure and formed of a plurality of blades arranged around a circle and with a wing-like portion at the front;

a circular division board fastened between an inner wall surface of said housing and said turbine vane;

a screen member mounted on said center shaft at the back of said turbine vane, being formed of stainless steel wire gauze in 300 meshes per inch;

a filter device mounted on said center shaft at the back of said screen member, comprising a cylindrical body formed of a plurality of aluminum alloy round rods retained by a hoop at the middle and supported by two circular frame members at two opposite ends;

a ring-shaped member fastened on the circular frame member at the rear end of said filter device;

a ring-shaped retainer device formed of four pieces of elements respectively fastened on said ring-shaped member, said elements having each two connecting portions at two opposite ends with a hole each made thereon, the connecting portions of each element being connected with one connecting portion of another element by screw means, said ring-shaped retainer device having a plurality of compression springs equidistantly fastened in its periphery and respectively stopped against the inner wall surface of said housing;

a circular fastening plate having a plurality of bolt holes with a screw means each respectively fastened therein to secure to said ring-shaped retainer device; and a tubular wire gauze filter superimposed on said turbine vane and said filter device;

wherein the explosive gas from said engine into said housing through said exhaust gas inlet forces said turbine vane to carry said filter device to rotate and is filtrated through said wire gauze filter, said screen member and said filter device and exhausted out of said housing into the air through said exhaust gas outlet.

2. An exhaust pipe according to claim 1, wherein said filter device comprises said aluminum round rods closely connected together and arranged to form a cylindrical body which filtrates impurities and residues from exhaust gas passing therethrough and spins filtrated impurities and residues toward said tubular wire gauze filter by centrifugal force resulted during it rotation.

3. An exhaust pipe according to claim 1, wherein said turbine vane and said filter device are connected to said center shaft in series and respectively made of acid-proof, alkali-resisting, and light weight material, and said center shaft has two opposite ends fastened in two bearings mounted on said front and rear flanges at the center and is permitted to rotate on said front and rear flanges without consuming much energy or giving much load to said housing.

4. An exhaust pipe according to claim 1, wherein said exhaust gas outlet is closed and said two drains are opened so that water can be filled in said housing for discharge through said drains to remove dirt out of said housing.

* * * * *